US012774866B1

(12) United States Patent
Vinroe et al.

(10) Patent No.: US 12,774,866 B1
(45) Date of Patent: Oct. 27, 2026

(54) TRIGGER GROUP FOR STRIKER FIRED-STYLE PISTOLS

(71) Applicant: Jordan J. Vinroe, Portersville, PA (US)

(72) Inventors: Jordan J. Vinroe, Portersville, PA (US); Ian Thomas Kerstetter, Sunbury, PA (US); William Daniel Baylor, Selinsgrove, PA (US)

(73) Assignee: Jordan J. Vinroe, Portersville, PA (US)

( * ) Notice: Subject to any disclaimer, the term of this patent is extended or adjusted under 35 U.S.C. 154(b) by 143 days.

(21) Appl. No.: 18/445,078

(22) Filed: Mar. 30, 2023

Related U.S. Application Data

(60) Provisional application No. 63/372,759, filed on Apr. 1, 2022.

(51) Int. Cl.
*F41A 19/33* (2006.01)
*F41A 17/64* (2006.01)

(52) U.S. Cl.
CPC ..... *F41A 19/33* (2013.01); *F41A 17/64* (2013.01)

(58) Field of Classification Search
CPC ..... F41A 19/33; F41A 17/64
See application file for complete search history.

(56) References Cited

U.S. PATENT DOCUMENTS

| | | | | |
|---|---|---|---|---|
| 8,667,881 | B1 * | 3/2014 | Hawbaker | F41A 19/45 42/69.01 |
| 9,146,066 | B1 * | 9/2015 | Cason | F41A 19/24 |
| 10,107,580 | B2 * | 10/2018 | Fellows | F41A 17/46 |
| 10,816,297 | B1 * | 10/2020 | Williams | F41A 19/46 |
| 11,644,261 | B2 * | 5/2023 | Fellows | F41A 19/10 42/42.01 |
| 11,828,552 | B1 * | 11/2023 | Stojakovic | F41A 19/10 |
| 2022/0364812 | A1 * | 11/2022 | Fellows | F41A 19/24 |

* cited by examiner

*Primary Examiner* — Bret Hayes
(74) *Attorney, Agent, or Firm* — Robert B. Famiglio; FAMIGLIO & ASSOCIATES

(57) ABSTRACT

A trigger group apparatus directed toward use in striker-fired style pistols. The apparatus includes a trigger housing, a trigger bar, a striker with a firing pin which includes a leg at the rear of the striker, a cruciform sear with polyhedron appendage affixed to the sear, a safety plunger which interacts with the striker guiding the striker movement, a connector mounted on the trigger group and a binary disconnector interacting with the sear slidably mounted on a disconnect bar. The sear interacts with the connector and binary disconnector to facilitate release of and then capture of the striker with each movement of the trigger bar to assure limiting the pistol to semiautomatic operation while providing for firing one pistol round for the pull of the pistol trigger and one round when the pistol trigger is released.

3 Claims, 10 Drawing Sheets

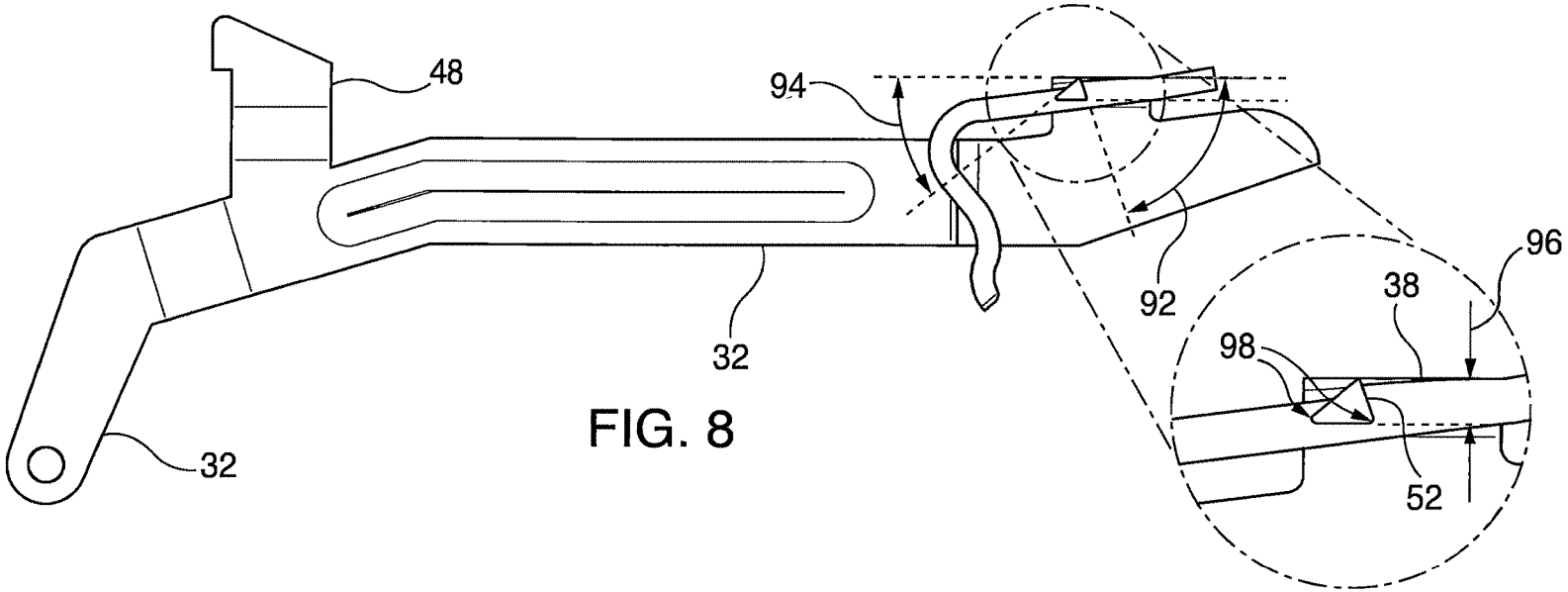
FIG. 8
FIG. 8A
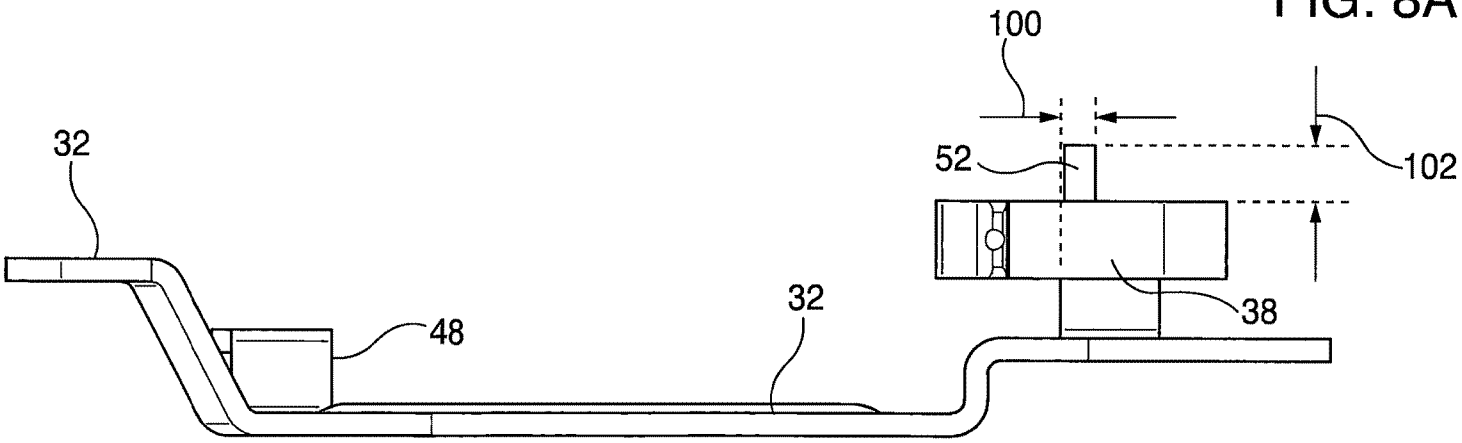
FIG. 9

TRIGGER GROUP FOR STRIKER FIRED-STYLE PISTOLS

CROSS REFERENCE TO RELATED APPLICATIONS

This application claims the benefit of Applicant's provisional patent application Ser. No. 63/372,759 filed Apr. 1, 2022, entitled Trigger Group for Striker-Fired Style Pistols.

BACKGROUND OF THE INVENTION

1. Field of the Invention

This invention relates to a semi-automatic striker-fired style firearms. More particularly, the disclosed invention is an apparatus and method in which the trigger group on an existing striker-fired style pistol may be converted to allow and maintain legal semi-automatic operation but fire one round upon one pull of the trigger and then firing one additional round only upon release of the trigger.

2. Background Art

Striker-fired pistols are at least one hundred years old, the first one being designed in 1919 by Heinrich Ortgies. Others in history believe that John Moses Browning, who invented the legendary 1911-style military pistol also designed a striker-fired pistol. Others argue that striker-fired pistols had been produced in lesser known quantities earlier in history. However, it is widely accepted that in modern firearms design, the first semi-automatic pistol with counteracting spring control mechanism was developed by Gaston Glock of Vienna, Austria. Glock was issued a U.S. Pat. No. 4,539,889 dated Sep. 10, 1985 which details the design and operation of the first most popular striker-fired pistol of modern times, the Glock® model 17, which is still produced today along with other similar Glock® striker-fired pistol designs. Many other manufacturers have adopted similar striker-fired pistols, some of which are clones copying the Glock® design.

Like all handguns legally sold to the public in the United States, striker-fired pistols as well as conventional hammer-fired pistols are semi-automatic in design. Semi-automatic means one round of ammunition is fired from the pistol for each pull of the trigger mechanism. Conventional semi-automatic designs, including striker-fired pistols require cycling of the trigger to the return position before the pistol resets to allow for another single shot from the pistol after it auto loads the next round.

Those skilled in the art of gunsmithing or firearms technology understand that a trigger group includes the parts of a firearm that initiate the firing of a bullet, whether a pistol, rifle, or other firearms including shotguns or any other weapons. In a trigger group, typically parts include the trigger which is a lever tripped by the shooter's fingers of the firing hand by pressing back on the trigger. As the trigger is pulled, in a Glock® pistol for which the present invention was initially designed, the trigger part pulls the firing pin (striker) back. A connector guides the triggering bar forward releasing the firing pin which allows it to strike the bullet primer without the use of a conventional hammer as used in many conventional and modern pistols.

In the operation of conventional firearms, and particularly the striker-fired pistols which remain popular at the time of this disclosure, a striker pin which fires a single round of ammunition is held in place after cycling from one pull of the trigger. The striker remains in place after firing until the trigger is released and the pistol, being charged with another round of ammunition, is ready for firing again upon an additional rearward pull of the pistol trigger.

Federal law as presently interpreted by the Bureau of Alcohol, Tobacco and Firearms defines a semi-automatic firearm, including a pistol, related to the pull of the trigger as a function and the release of the trigger as a second function. This is significant since the present invention discloses a trigger group which allows a striker-fired pistol, in the preferred embodiment a Glock® style pistol or clone copy, to fire two separate shots more quickly than if pulling a trigger back twice in succession. It would be advantageous to fire one round at the pull of the trigger and a second round at the release of the trigger. As a result the firearm converted with the present invention fires a shot upon the pull of the trigger and fires a second shot only upon the release of the trigger but it is not considered a machine gun, a fully automatic firearm or special type of weapon defined by the National Firearms Act.

Automatic firing Glock® style pistols are manufactured, such as the Glock model G18 and G18C. Such pistols provide selectable semi-automatic and fully automatic fire using a factory designed auto sear. These firearms are not legal for most individuals to own or possess in the United States. Further, the prior art does teach conversion of semi-automatic Glock® style pistols such as described in U.S. Pat. No. 5,705,763 issued to Jorge A. Leon on Jan. 6, 1998. Glock® style pistols, if converted as taught in such patent, are highly restricted in the United States and may only be possessed in this country by properly authorized military, law enforcement and duly licensed federal firearms dealers as samples.

However, the present invention is not subject to the same associated legal restrictions and does not operate as defined in U.S. Pat. No. 5,705,763, a device commonly referred to as a "switch" by regulators and is illegal for virtually all civilians to own. It is known to those skilled in the art that a firearm defined as a machine gun or a fully automatic weapon will continue to fire upon the single pull of the trigger until the ammunition carried in the magazine or other ammunition storage mechanism of the pistol or rifle is expended or the trigger is released. The present invention is not drawn to convert a Glock® style pistol to a fully automatic pistol under any circumstances and is not adaptable to fully automatic fire. Accordingly, there is a need for a proprietary designed and shaped trigger group which includes an altered geometry of the sear and ramped safety plunger that can be activated on both the pull and release of the trigger mechanism to allow for a double shot function to operate on a Glock® style pistol but remain legal to own as a semi-automatic pistol and retain the advantages of the safety mechanism. Such a new and improved trigger group for the Glock® style pistols is described in this disclosure.

Accordingly, it is the object of the present invention to address the restrictions and limitations described in the existing background art to allow for a simple, reliable and legally obtainable means for an otherwise authorized individual who can own a striker-fired semi-automatic pistol allowing the manual firing of two shots in rapid succession without allowing automatic fire as defined by the restrictions described above.

SUMMARY OF THE INVENTION

The present invention is a new and useful improvement and functions specifically with a Glock® style pistol. Unlike other firearms which use a binary firing type of mechanism to allow a firing of a rifle upon the pull of the trigger and a second firing upon the release of the trigger, such are not applicable or immediately available to use on the striker-fired pistols and in particular a Glock® brand pistol. There are various reasons for this known to those skilled in the art of firearm design and gunsmithing techniques.

The disclosed apparatus is fashioned to provide a drop-in trigger replacement group for existing pistols including Glock® brand using double stacked magazine models known as G17, G19, G22, G23, G27 and G28, or similar sized models and clones of this pistol whether of generation 1 through 5 inclusive. Moreover, the disclosed invention can be easily fashioned to operating on similar pistols which use single stack ammunition magazines such as the Glock® brand G43, G20 or G21 by using the design parts taught in this disclosure with appropriate sized trigger housings for such smaller firearms which otherwise use the same type of trigger operations.

The present invention allows the firing of a first round out of a Glock® pistol upon the pull of the trigger to the rear and then a second firing of a round only upon release of the trigger which returns to a trigger reset position without modification of the firearm except to install a "drop in" installation of the trigger group apparatus disclosed herewith.

In Glock® pistols, one problem which the present invention solves to obtain a two shot, semi-automatic operation is by addressing the issue in a Glock® pistol regarding the striker capture mechanism. The conventional safety provided by the sear on such striker-fired pistols would prevent the disclosed trigger group, used alone, from firing a second round of ammunition when the trigger is released because the striker, comprising the firing pin in striker-fired pistols is retained because the sear integrated into trigger bar in such Glock® firearms captures that firing pin and would not allow the second shot upon release of the trigger.

A trigger bar on a Glock® pistol captures a downward projecting appendage, a leg-like structure, on the firing pin upon the recoil of the pistol slide by urging the sear upward upon return of the pistol slide and holds the firing pin until the trigger is completely released and therefore reset. The stock trigger connector provided in Glock® brand pistols interacts with the cruciform sear from the factory to arrest forward travel of the firing pin in the slide of the pistol after one round is fired. The factory designed sear moves upward after the slide begins to return thereby capturing a downward extending tab of the firing pin to prevent the firing pin from springing forward and firing another shot while the trigger remains in the rearward, pulled position. This upward action of the sear, if prevented, would be considered automatic fire operation as the firing pin and associated hardware would then continue to fire as long as the trigger is depressed. Such automatic operation is to be avoided and prevented for the reasons discussed. The stock Glock® trigger assembly and design prevents this from being possible.

The invention described uses the existing general designs found in virtually all Glock® brand pistols but allows the release of the sear separately upon release of the trigger in the forward direction by dropping the sear to allow release of the striker using a binary disconnect member which resets by longitudinal movement and is reset by the movement of the trigger bar to the forward, reset position after the first shot made from the rearward pull of the trigger with minimal or no changes required to the existing firearm except for a drop in trigger group replacement.

BRIEF DESCRIPTION OF THE DRAWINGS

FIG. 8 is a plan side view of the trigger bar of the present invention.

FIG. 8A is a detailed and expanded view of the geometry of the modified cruciform sear arm attached to the sear illustrating the triangular prism-shaped polyhedron appendage as attached to the trigger bar depicted in FIG. 8.

FIG. 9 is a top plan view of the trigger bar of FIG. 8 rotated ninety degrees on its longitudinal axis.

DETAILED DESCRIPTION OF THE INVENTION

Figure 1:
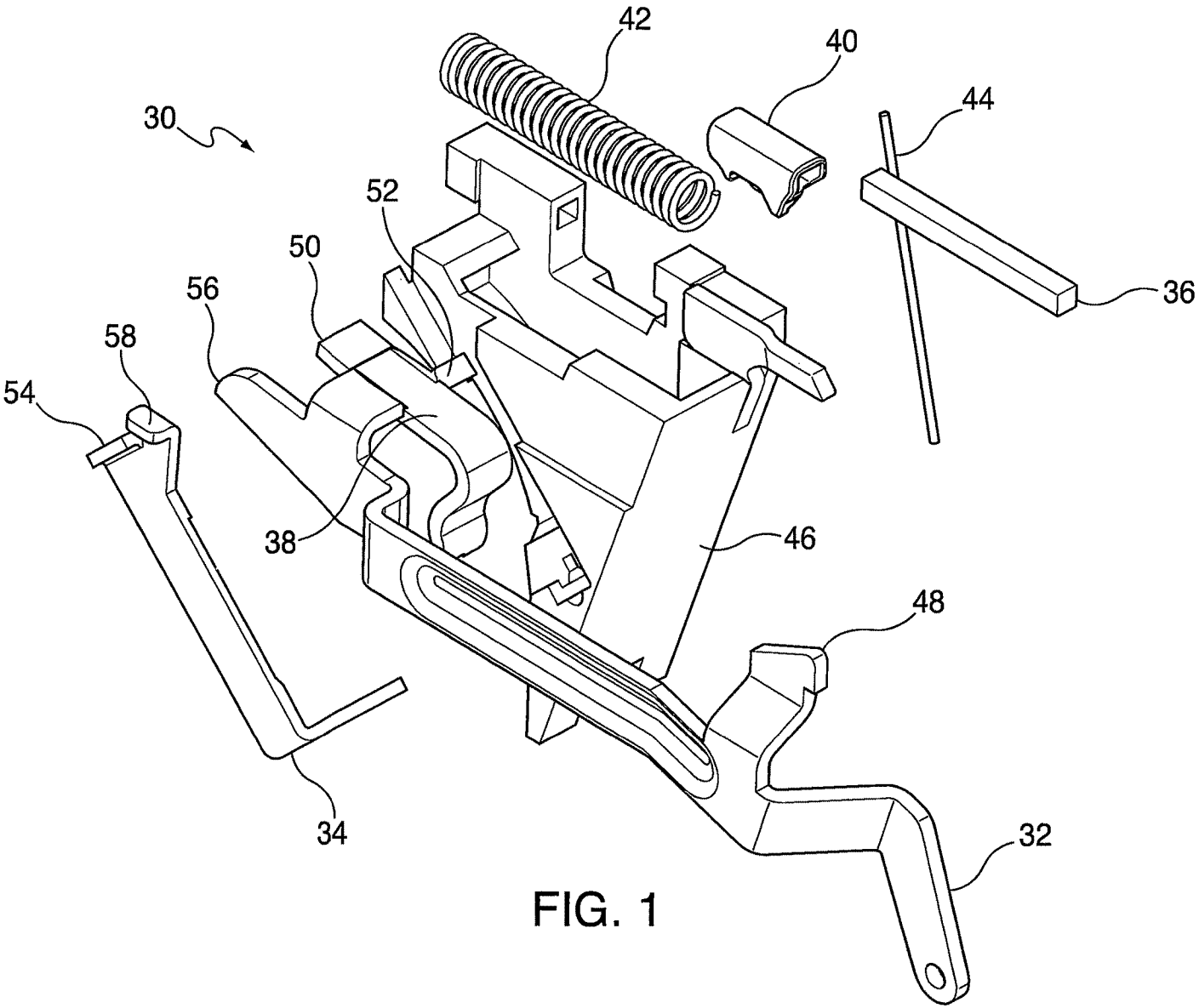
FIG. 1 is an exploded view of the entire trigger group that comprises the present invention.

Turning now to FIG. 1, an exploded view of entire trigger group 30 is shown. It should be appreciated that trigger group 30 is sized to be a drop in replacement for existing Glock® style pistols and therefore sizes and dimensions are dictated by the pistol to which trigger group 30 is being installed. The description provided herein illustrates the improvements presented over the original equipment Glock® style pistol design which has also migrated in some instances to trigger groups found in other Glock® style pistol imitations and clones found on the firearm market. Trigger housing 46 is dimensioned to interface with other existing original equipment parts and fit within the lower receiver of the pistol being modified as described herein. References found herein may be best understood in comparison to the trigger operation of the prior art to best appreciate the improvements and operations of the present invention.

Figure 12:
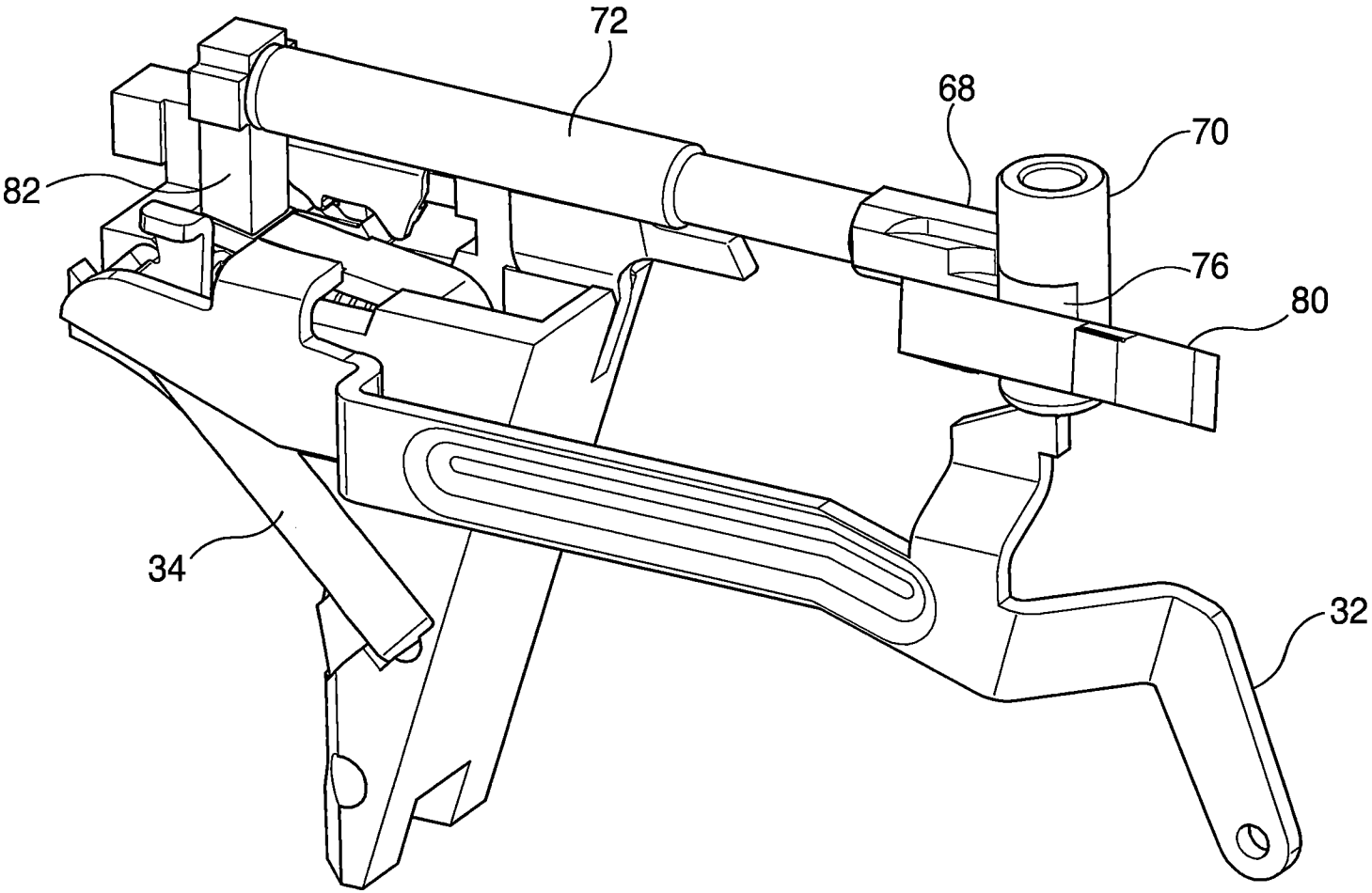
FIG. 12 is a detailed perspective view of the invention including the firing pin, extractor, binary disconnect and safety plunger viewed from the right side of the trigger group.
Figure 13:
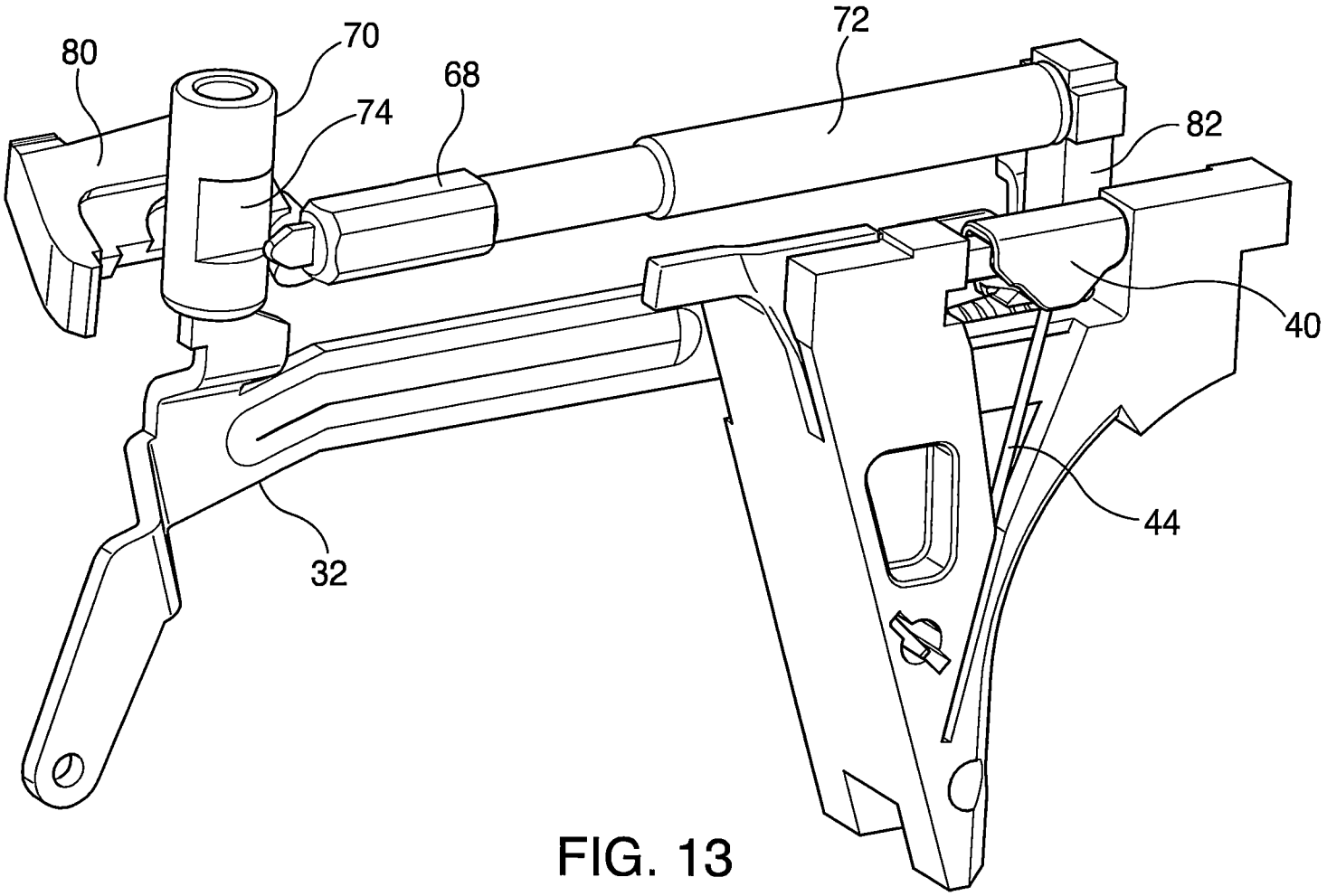
FIG. 13 is a detailed perspective view of the invention including the firing pin, extractor and safety plunger viewed from the left side of the trigger group.

Trigger bar 32 interacts with connector 34 as trigger bar cruciform sear 38 moves rearward upon pull of the pistol trigger which moves trigger bar 32 rearward. Sear face rear 50 is engaged with the firing pin leg 82, which is illustrated in FIGS. 12 and 13 to be discussed below. In conventional operation, trigger bar 32 contacts connector ramp 54 by interaction between trigger bar rear shoe 56 and connector ramp 54. It can be appreciated from the figures that upon contact between shoe 56 and ramp 54 cruciform sear 38 moves in a downward direction thereby releasing firing pin leg 82 as the sear face rear 50 moves downward. A conventional trigger group being replaced with the present invention operates in this fashion. The improvements taught herein provide for operation of the pistol upon the release of the trigger such that a second shot can be fired during what otherwise would be considered the reset portion of the trigger operation upon release. Trigger return spring 42 is shown but is part of the existing pistol type operation and is provided for reference only.

In existing Glock® style pistols, upon pressing the trigger of a cocked and loaded pistol firing pin 72 is released when cruciform sear 38 moves downward as trigger bar rear shoe 56 intersects connector ramp 54 forcing the cruciform sear 38 downward. When the striker recoils rearward after a round is fired, a ramp machined into the inner side rail of Glock® style firearms slides resets the trigger by intersecting connector tip 58 on connector 34 when the slide is forced back after firing a shot, the cruciform is forced back up to a position to capture the firing pin leg 82 to prevent the firing pin spring from driving the firing pin forward to cause another round to go off. As the firing pin has been captured, this is the essence of semi-automatic operation of a standard Glock® style pistol. When the trigger on the pistol is reset by returning it to the full forward position, cruciform sear 38 has already returned to its fully upward and forward position preparing to release the firing striker for the next semi-automatic shot upon the next pull of the trigger.

FIG. 1 also presents a critical part of trigger group 30, that being binary disconnect 40 which is mounted on and is slidable forward and rearward with binary disconnect bar 36 as will be illustrated in more detail in the additional figures being presented below. Trigger bar 32 facilitates release of the cruciform sear 38 downward from firing pin leg 82 as will be shown in FIG. 12 and FIG. 13 and discussed below. Striker firing pin 72 is a conventional Glock® style pistol striker firing pin found in such pistols currently and with which the present invention is meant to operate.

Binary disconnect 40 moves forward when the pistol trigger is released to activate the firing of an additional shot on the release of the trigger which moves trigger bar 32 forward. Binary disconnect 40 is under spring tension from disconnect spring 44 to return disconnect 40 to its starting position for the following shot and to ensure that the pistol cannot discharge a second round without movement of the trigger bar 32 forward by the user. Trigger bar 32 is operatively connected to the trigger which conventionally operates the pistol but is not shown in the figures for clarity. However, it should be appreciated that trigger bar 32 is always operatively connected to the trigger mechanism that interfaces with the finger of the user of the pistol.

Figure 2:
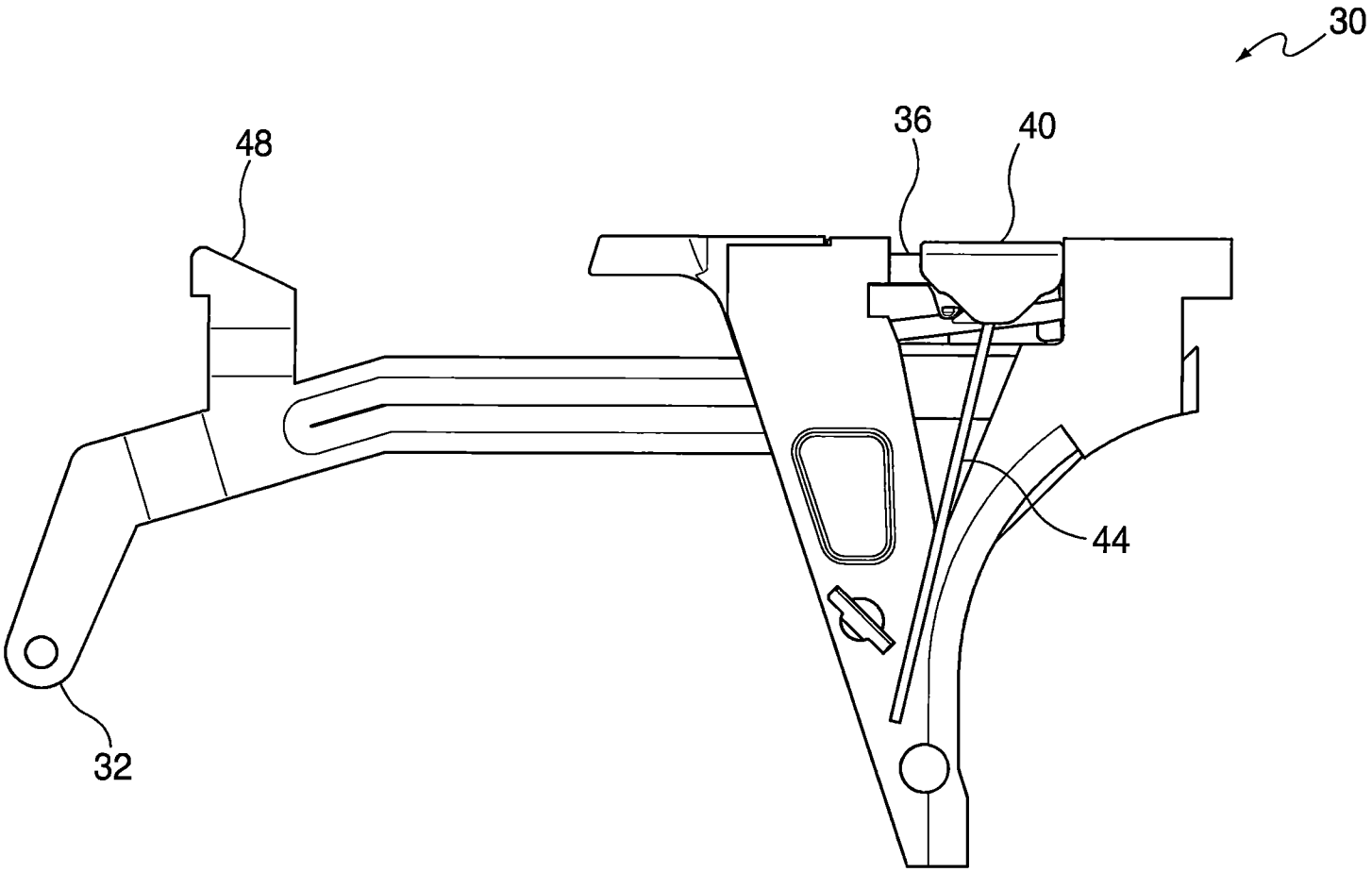
FIG. 2 is a side plan view of the trigger group particularly illustrating the slidable binary disconnect and its spring.

Turning to FIG. 2, a side view of the trigger group 30 provides more detail and an illustration of the slidable binary disconnect 40 in a slidable position with binary disconnect bar 36 and connected to disconnect spring 44. FIG. 2 illustrates the position of the linear binary disconnect spring 44 which provides a spring force bias to disconnect 40 which is in slidable connection on disconnect bar 36.

Figure 3:
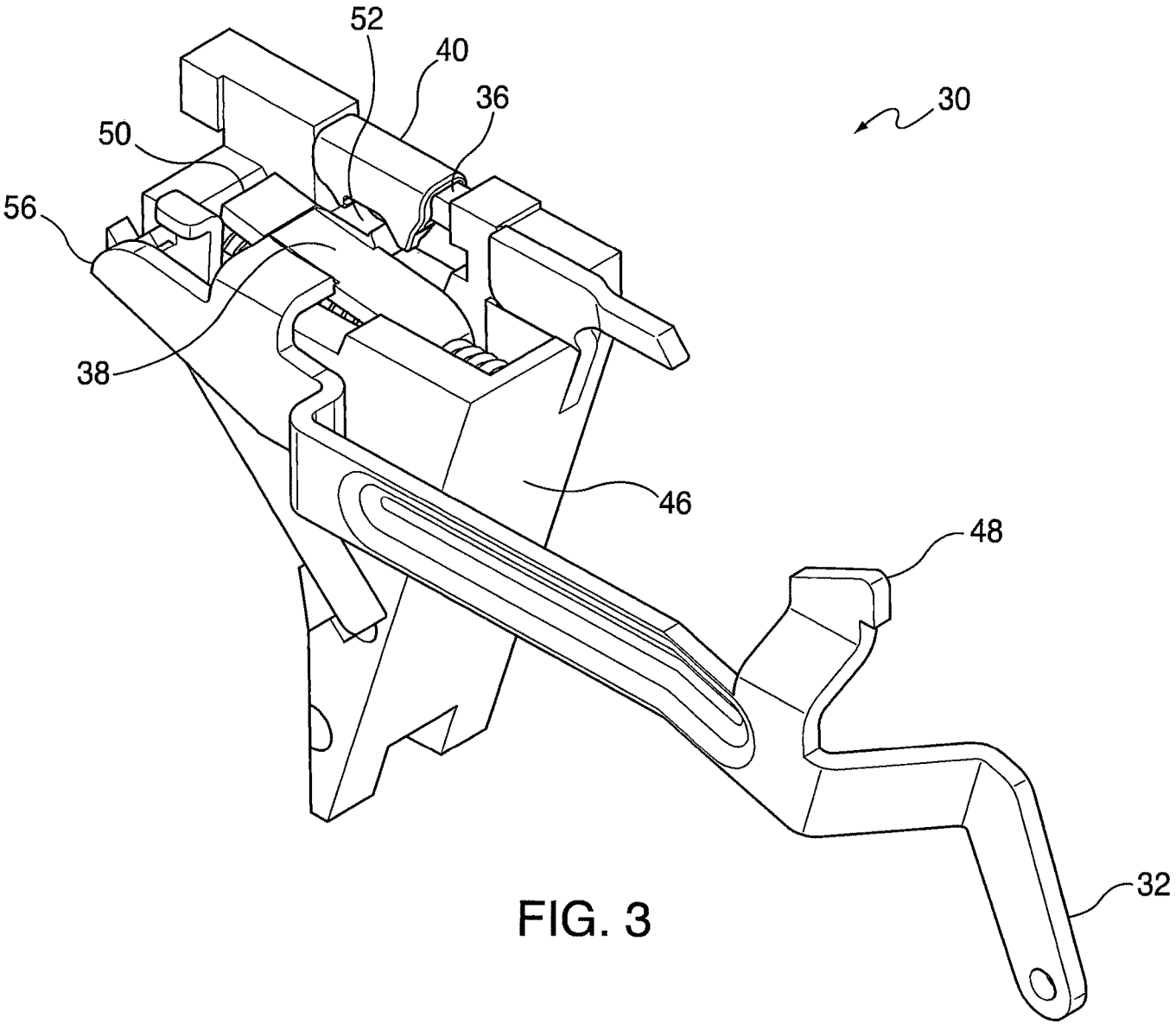
FIG. 3 is a pictorial view of the trigger group of FIG. 1 in its assembled configuration.

FIG. 3 is a perspective view of trigger group 30 generally illustrated in FIG. 1 as an exploded view but in a fully assembled configuration. Trigger group 30 is presented as it would be dropped into an existing Glock® pistol, replacing the original equipment manufacture trigger group in order to practice the present invention. FIG. 3 presents all of the parts and elements displayed in FIG. 1 with the exception of the trigger return spring 42 shown in FIG. 1 which is not replaced by the present invention as the original spring may be used. In FIG. 3, it can be seen that cruciform sear polyhedron appendage 52 is shown in place as it would be operating in conjunction with binary disconnect 40 in order to allow cruciform sear 38 to operate and release firing pin leg 82 as illustrated in FIG. 12 and FIG. 13 as further as discussed below.

Figure 4:
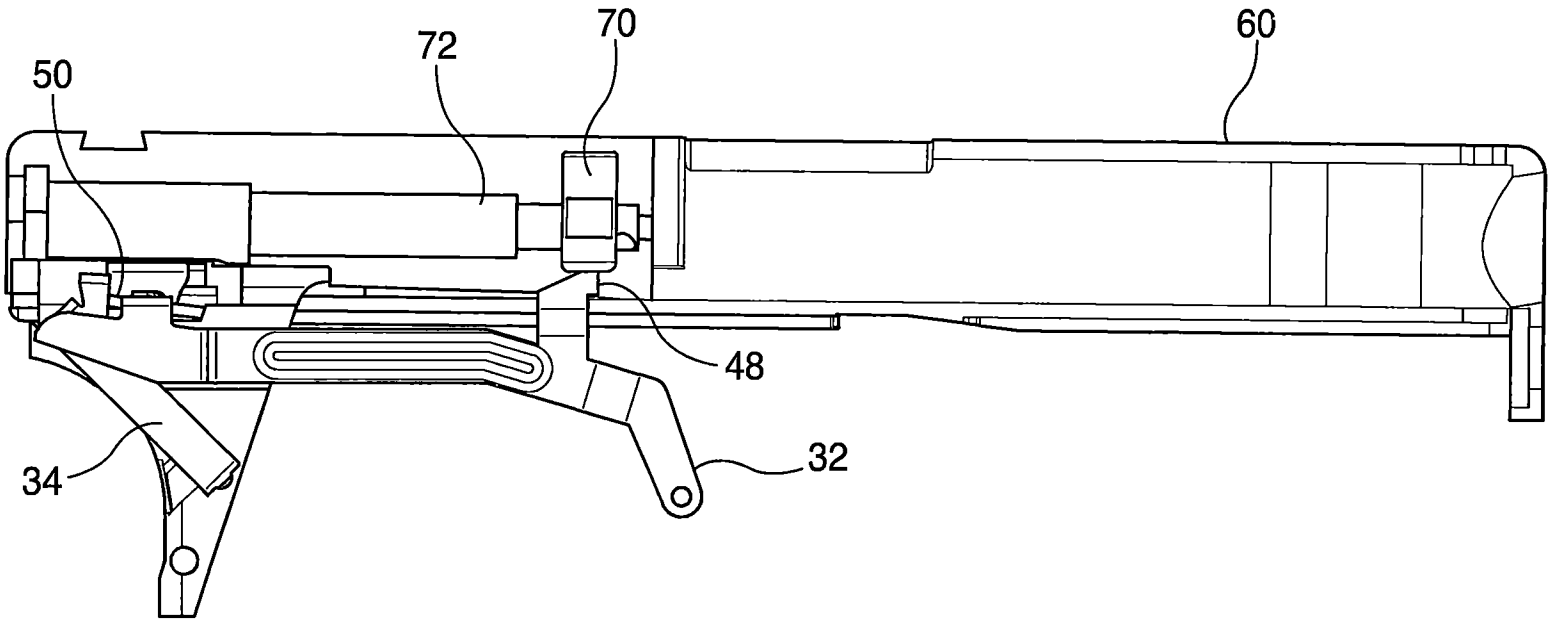
FIG. 4 is a cutaway view of a conventional Glock® pistol slide with the trigger group in place interacting with the firing pin and the safety plungerin place as configured in the present invention.

FIG. 4 presents a cutaway view of a conventional Glock® pistol slide 60 illustrating the internal configuration of the pistol components with the present invention. As can be seen in the pistol design that FIG. 4 illustrates the relationship of trigger bar 32, connector 34, trigger bar safety plunger shoe 48 and firing pin safety plunger 70. Safety plunger 70 is similar in basic shape and overall dimensions to the original equipment manufacture safety plunger of Glock® style pistols. The detent cutout dimensions are different however.

Figure 6:
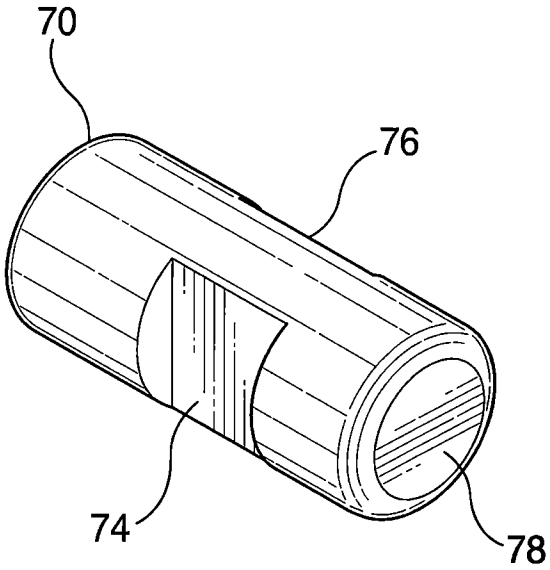
FIG. 6 is a perspective view of the safety plunger.
Figure 5:
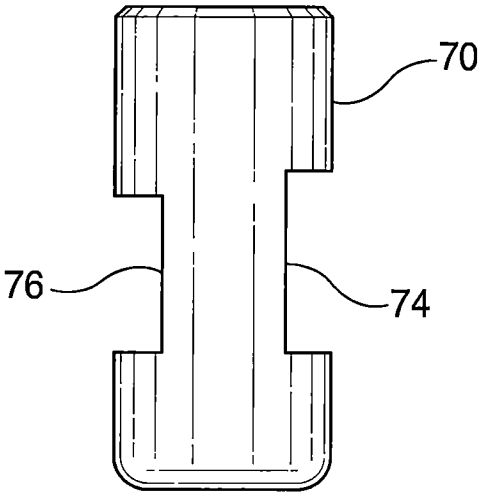
FIG. 5 is a detailed view of the safety plunger modified.
Figure 7:
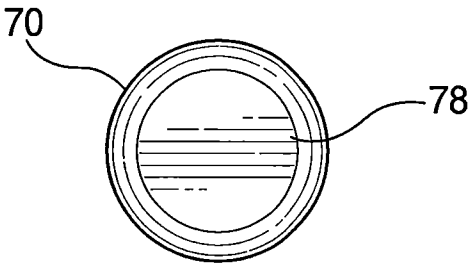
FIG. 7 is a top view of the safety plunger.

Plunger 70 as known to those familiar with the operation of Glock® pistols is an additional safety device that prevents striker 72 from moving forward until trigger bar 32 is moved upon depressing of the pistol trigger thereby shifting trigger bar safety plunger shoe 48 to the rear and allowing a spring operating upon safety plunger 70 to move and free striker firing pin 72 to move forward upon further depressing of the trigger which moves the cruciform sear 38 downwardly thereby allowing sear face rear 50 to free firing pin leg 82. Firing pin safety plunger 70 in FIGS. 5, 6 and 7 illustrates geometry of the plunger used to replace the original equipment manufacture plunger. A directional arrow can be placed on plunger surface 78 for proper installation given the asymmetry of the cutouts shown in FIG. 5. While the original Glock® style safety plunger may function with the invention, it has been discovered that an enlarged detent 74 assures reliable operation. In the present invention, the trigger safety plunger 70 is asymmetrical relative to the cutout portions, being safety plunger firing pin detent 74 and extractor detent 76 when compared to the original equipment plunger in the existing Glock® style pistols. Firing pin detent 74 is larger than extractor detent 76.

FIG. 5 is a side view of safety plunger 70 illustrating the difference in dimensions on the proprietary plunger illustrated which replaces the plunger typically used in Glock® style pistols. In FIG. 5, firing pin safety plunger 70, dimensioned generally the same length and measured about the outer most circumference, is similar in overall dimensions to that found in the conventional Glock® style pistol. However, unlike the pistols the present invention improves, plunger 70 utilizes directional cutouts to allow proper functioning of the pistol with the invention on firing pin side 74 only while keeping the injector cutout shown at extractor detent 76 similar to the original equipment manufacture.

FIG. 6 is a perspective view of plunger 70 illustrating the arrow at safety plunger top 78 as used in the preferred embodiment.

FIG. 7 is a top view of plunger 70 illustrating plunger top 78 which presents an arrow for the user of trigger group 30 to replace the existing plunger.

In the present invention, the improvement provides for sear 38 to be depressed again after the trigger is pulled and the slide reciprocates, reloading a cartridge in the pistol while the trigger is still depressed. Upon release of the trigger, the prior art captures the firing pin by restraining leg 82 until release and reset of the trigger.

Figures 10, 11:
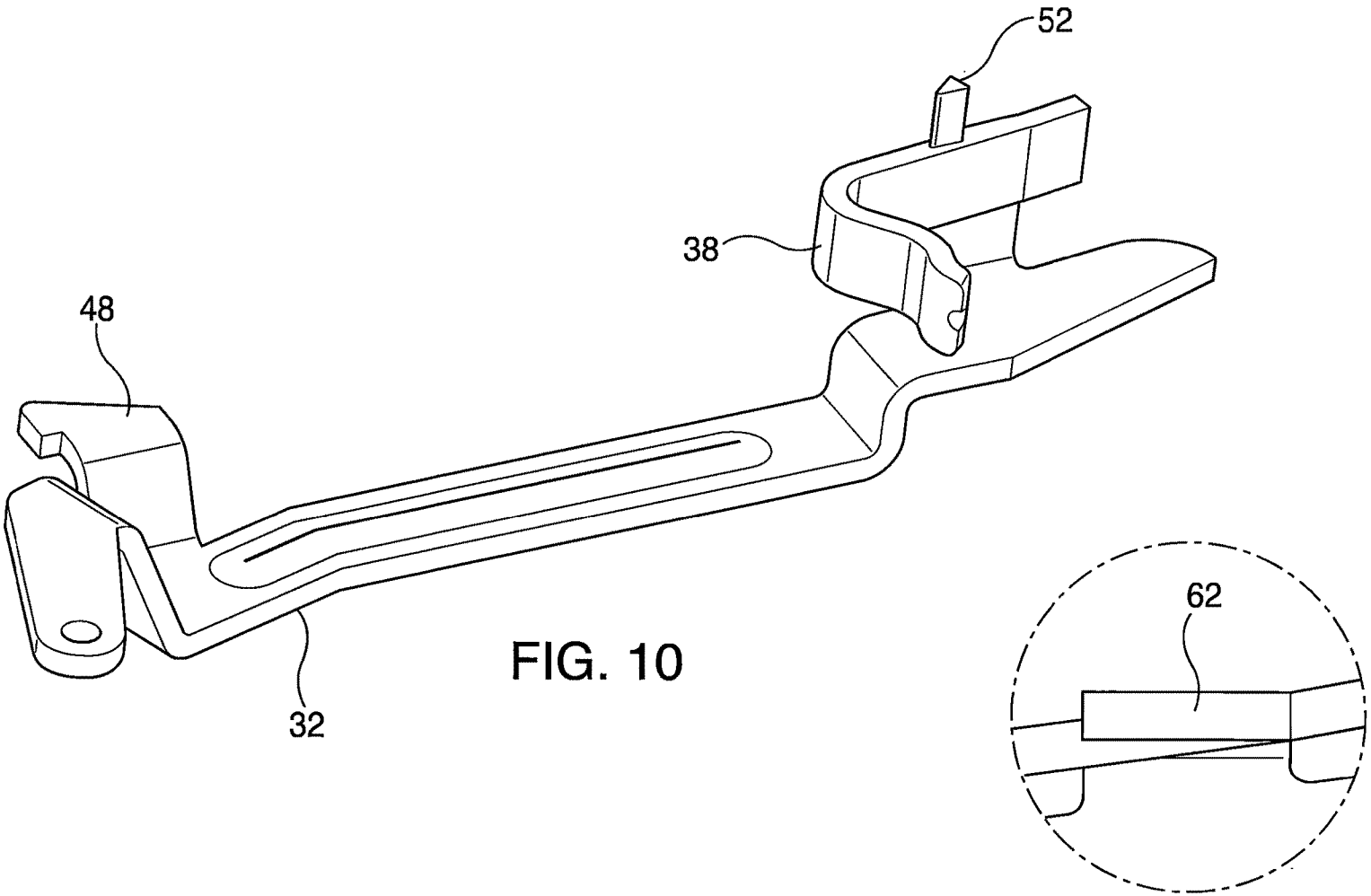
FIG. 11 (PRIOR ART)
FIG. 10 is a perspective view of the trigger bar used in the present invention.
FIG. 11 is a detailed view of the cruciform sear arm appendage illustrating the original equipment manufactured geometry as used in the prior art in contrast to the proprietary geometry shown in FIG. 8A.

FIG. 8 is a side plan view of trigger bar 32 which provides more detail about appendage 52 which is modified over the appendage design used in the original equipment for a Glock® style pistol which, for reference, is shown in FIG. 11 as the prior art in a side view. It should be appreciated that the details of appendage 52 are broken out in FIG. 8A allowing a comparison between sear appendage 52 and the prior art shown in plan view in FIG. 11. Appendage 52 having three (3) sides is formed at angles which provide for the operation of sear 38 to allow for firing of the pistol on the release of the trigger. Angle 92 at the rear of appendage 52 is approximately seventy-one degrees (71°). Angle 94 at the front of appendage 52 is approximately forty degrees (40°) with details of the invention along with the existing striker mechanism operable with the plunger is depicted at 96 being 0.051 inches in the preferred embodiment. The bottom edge breaks of appendage 52 are depicted at 98 in FIG. 8A.

A difference between the present invention and the conventional original equipment provided in the Glock® style pistol can be appreciated by comparing FIG. 11 which depicts the prior art with FIG. 8A of the present invention. In FIG. 11, prior art inner appendage 62 is altered to the geometry shown with appendage 52 in FIG. 8A in which the details of the modified appendage of the cruciform sear 38 can be more fully appreciated.

FIG. 9 is a plan view of trigger bar 32 and its constituent parts shown in FIG. 8 but viewed from the bottom of the pistol looking upwards. The bottom of sear 38 can be seen with polyhedron appendage 52 extending laterally normally rests in a rearmost position as can be seen in FIG. 2. Appendage 52 length 102 is 0.125 inches and the width 100 of appendage 52 is 0.078 inches.

Turning to FIG. 10, a perspective view of trigger bar 32 is shown. FIG. 10 is a perspective of the same trigger bar 32 and its constituent components as shown in FIG. 8 and FIG. 9 but in a perspective view to appreciate the spatial relationship of the different components of trigger bar 32.

FIG. 12 is a perspective view of the details of the invention shown in operation with striker firing pin 72 and plunger 70. The view in FIG. 12 is from the right side of the pistol interior mechanisms with the rear of the pistol being oriented to the left side of FIG. 12. In contrast, FIG. 13 provides a detailed perspective view of the invention as in FIG. 12 but allows for details viewed from the left side of the pistol with the rear of the pistol oriented to the right of FIG. 13. Firing pin collar 68 is shown in FIG. 13 which is designed to interoperate with plunger 70 in both the original equipment prior art and in the present invention. As discussed above, safety plunger firing pin detent 74 is enlarged in the vertical direction to allow improved operation of striker firing pin 72 by providing additional clearance for firing pin collar 68 over the original equipment. Spent cartridge ejector 80 is depicted in FIG. 12 and FIG. 13.

Binary disconnect 40 is shown in FIG. 13 in more detail so that its forward and rearward movement in operation can be more fully appreciated. Disconnect 40 begins operation during the first rearward pull and therefore firing of the pistol in the rearward position as depicted in FIG. 13. Once cruciform sear 38 releases striker firing pin 72 upon the pull of the trigger rearward, binary disconnect 40 is moved forward by the return of sear 38 by contact of appendage 52 and binary disconnect leg rear surface 66. Appendage 52 is in slidable contact with leg rear surface 66 so that sear 38 moves downward upon moving to the forward position and therefore releases firing pin leg 82 in a similar fashion as the operation of the pistol upon the rearward pull of the trigger on the present invention just as in the prior art single shot per trigger cycle pistol. Binary disconnect 40 is designed to stop as it is driven forward and contacts trigger housing 46 thereby causing sear 38 to return to a full forward position and upright movement allows sear 38 to recapture the striker to prevent an additional firing until trigger bar 32 is pulled once again by the trigger.

After the second firing of a round from the pistol, binary disconnect 40 is then returned to its rearward most position on binary disconnect bar 36 driven by the tension in binary disconnect spring 44. The pistol is in a cocked and ready position to fire another shot only upon movement of trigger bar 32 rearward again and then sear 38 is prepared to release striker firing pin 72 for the second firing of the pistol upon release and forward movement of trigger bar 32.

Figure 14:
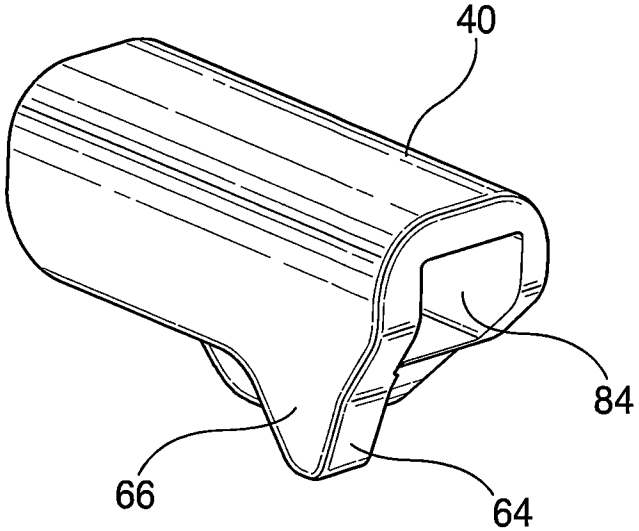
FIG. 14 is a perspective view of the binary disconnect of the present invention.

FIG. 14 is a perspective view of binary disconnect 40 showing the details of binary disconnect leg 64 and the binary disconnect bar cavity 84 configured to ride on binary disconnect bar 36 as also shown in FIG. 2 and FIG. 3. Binary disconnect 40 employs binary disconnect leg rear surface 66 to force the cruciform sear polyhedron appendage 52 downward upon the release of the trigger as described to provide for a second release of firing pin 72.

Figure 15:
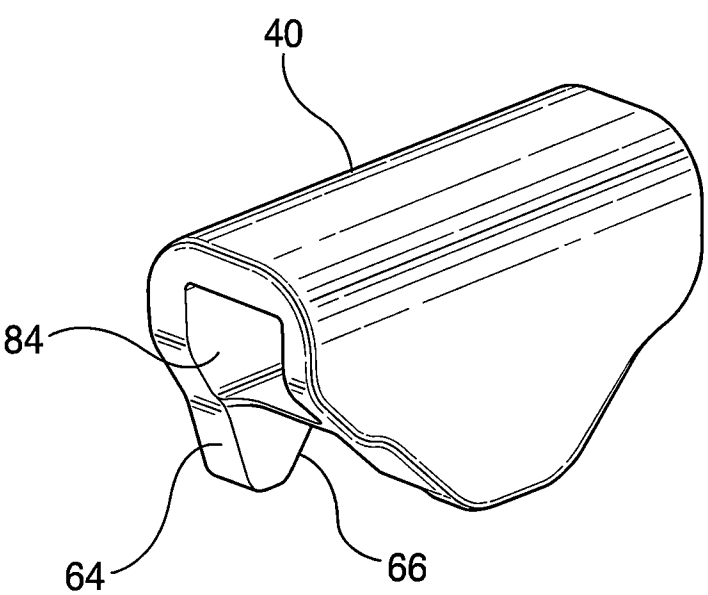
FIG. 15 is a perspective view of the binary disconnect of the present invention from a different viewing angle.

FIG. 15 is a view of binary disconnect 40 is shown in a perspective from the opposite side of trigger group 30 and binary disconnect bar 36. Leg rear surface 66, cruciform sear 38 slides downward to release firing pin leg 82 which frees striker firing pin 72 to execute the second firing of the pistol upon release of the trigger. As slide 60 recoils rearward upon the firing of the second shot, binary disconnect 40 is free to return to its original position rearward driven by the binary disconnect spring 44 bias. Thus a complete cycle of a first and then second shot is completed and the pistol is cocked for yet another shot upon the pull of the trigger and a second shot upon the release of the trigger.

As can be seen, disconnect 40 begins operation in the rearward position on binary disconnect spring 44 shown in the various figures. Following release of the trigger and a second firing of the pistol on the return of the trigger, spring 44 returns disconnect 40 to its starting position for the following shot from the pistol and to ensure that the pistol cannot discharge a second round without movement of the trigger by the user. Such function is strictly necessary for compliance with regulations prohibiting automatic fire of the pistol. In this regard, the present invention differs substantially from the automatic sear conversion switches taught in the prior art which operate to modify the operation of sear 38 and the rear of sear 50 through a different mechanism for automatic fire which is not possible or convertible to such operation as taught in the technology presented herewith.

Although the invention has been described in accordance with the preferred embodiment, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention.

What is claimed:

1. Trigger group apparatus for use in a semi-automatic striker-fired pistol, the apparatus comprising:

a trigger housing;

a connector;

a striker including a firing pin at one end, further including a leg at the opposite end from said firing pin configured to be selectively captured by a cruciform sear;

said striker further configured with a firing pin collar disposed at the firing pin end of the striker;

a trigger bar including a cruciform sear with an polyhedron appendage operatively affixed to the cruciform sear, the polyhedron appendage extending to and operatively in contact with a binary disconnector;

said binary disconnector including a disconnect spring affixed between the trigger housing and the binary disconnector to facilitate slideable movement of said binary disconnector, said binary disconnector slideably mounted on a disconnect bar, said bar of a length along the trigger housing, said disconnect bar being substantially parallel to said trigger bar;

the binary disconnector movable along the length of said disconnector bar between an initial first position and a second position in which contact between said binary disconnect and the trigger bar occurs to urge the trigger bar downwardly and away from the trigger bar's first position following a first movement of the trigger bar to release the striker, thereafter to capture the said striker after a first release of the striker and return and reset of the striker to the striker initial position;

the binary disconnector being moved along the binary disconnect bar to provide for a second release of the striker causing the pistol to fire a second shot upon the second movement of the trigger bar in the opposite direction returning said trigger bar to the first position, the binary disconnect bar causing the cruciform sear to move upwardly;

wherein further the said striker firing pin leg is thereby captured by the cruciform sear after the said second shot of the pistol.

2. The trigger group apparatus of claim 1 wherein said trigger bar further includes a safety plunger shoe extending upwardly from the trigger bar, said trigger group further including a firing pin safety plunger resting upon said plunger shoe, said safety plunger including a cutout dimensioned to fit said firing pin collar in slidable contact, said safety plunger disposed to guide said firing pin collar upon movement of the trigger bar.

3. A trigger group apparatus for use in a striker-fired pistol operated by manipulation of the pistol trigger, comprising:

a trigger housing;

a trigger bar for connection to the pistol trigger;

a striker with a firing pin, said striker including a leg disposed at the rear of said striker firing pin to contact a cruciform sear;

a connector mounted within the trigger group;

a binary disconnector slidably mounted on a disconnect bar, said bar mounted within the trigger housing, said binary disconnector including a binary disconnect spring, disposed to cause the binary disconnector to move forward and rearward sequentially upon movement of the trigger bar forward and then rearward;

the trigger group dimensioned to fit within said striker-fired pistol replacing the existing trigger group within said pistol;

said trigger bar disposed to be moveably attached to a pistol trigger and movably in contact with the connector;

the trigger bar including said cruciform sear positioned within the trigger group, the cruciform sear further including a polyhedron appendage moving a binary disconnector, upon contact of the trigger bar with a surface of a ramp on the connector, in a first dimension from a first position upon a first movement of the trigger bar that causes a first release of the striker with the firing pin, said cruciform sear moving to a second position to engage the firing pin leg to prevent release upon return of the striker until a second movement of the trigger bar, the said binary disconnector to move the sear to capture the striker after the first release of said striker;

wherein the trigger bar, upon release of the pistol trigger, is caused to return to the first position of the trigger bar by a trigger return spring and during the return of the trigger bar to the first position cause a second release of the striker with the firing pin.

* * * * *